US005826713A

United States Patent [19]

Sunago et al.

[11] Patent Number: 5,826,713

[45] Date of Patent: Oct. 27, 1998

[54] FLUID VESSEL

[75] Inventors: Seizo Sunago, Hyogo; Osamu Takahata, Osaka; Akira Kagayama, Nara; Hitoshi Futagawa, Shiga; Tetsuji Miyamoto, Osaka; Mitsuo Murakami, Hyogo, all of Japan

[73] Assignees: Fujisawa Pharmaceutical Co., Ltd.; Nissho Corporation, both of Osaka, Japan

[21] Appl. No.: 817,649

[22] PCT Filed: Oct. 27, 1995

[86] PCT No.: PCT/JP95/02215

§ 371 Date: Apr. 30, 1997

§ 102(e) Date: Apr. 30, 1997

[87] PCT Pub. No.: WO96/13241

PCT Pub. Date: May 9, 1996

[30] Foreign Application Priority Data

Oct. 31, 1994 [JP] Japan ..... 6-267069

[51] Int. Cl.[6] ..... B65D 25/08

[52] U.S. Cl. ..... 206/222; 206/219

[58] Field of Search ..... 206/219, 221, 206/222; 604/413

[56] References Cited

U.S. PATENT DOCUMENTS 4,936,841 6/1990 Aoki et al. .

5,170,888 12/1992 Goncalves ..... 206/222

5,261,902 11/1993 Okada et al. .

5,308,347 5/1994 Sunago et al. .

5,352,191 10/1994 Sunago et al. .

*Primary Examiner*—David T. Fidei

*Attorney, Agent, or Firm*—Oblon, Spivak, McClelland, Maier & Neustadt, P.C.

[57] ABSTRACT

A fluid vessel including a drug vessel with a mouth portion sealed with a penetrable plug, a vial guide which holds the drug vessel and a flexible solvent vessel. The flexible solvent vessel has a drug solution outlet port and a communication port to the drug vessel, and an integrally molded tubular guide portion concentrically surrounding the communication port. Also included is a slidable communication mechanism housed in the tubular guide portion for communicating an inside of the solvent vessel and an inside of the drug vessel. Furthermore, also included is a cap for housing the vial guide and for rotatably sealing an opening of the guide portion, and a drug vessel push-down mechanism for moving the drug vessel down towards the communication port of the solvent vessel. The fluid vessel further includes a communication sequence control device for controlling a communication sequence so that, when the cap is rotated, the vial guide is moved down, without rotating, and the plug of the drug vessel is first pierced, and then a thin film of the communication port of the solvent vessel is pierced, thus communicating the drug vessel with the solvent vessel.

18 Claims, 12 Drawing Sheets

FLUID VESSEL

This is a continuation of application Ser. No. PCT/JP95/02215, filed under 35 U.S.C. § 371.

TECHNICAL FIELD OF THE INVENTION

The present invention relates to a fluid vessel and, more particularly, to a fluid vessel for holding a dried drug such as a powder drug or a freeze-dried drug and its solvent in a separate state, and for mixing the dry drug and the solvent in the vessel in a sterile manner just before the use to supply the mixture as a solution for infusion.

BACKGROUND OF THE INVENTION

Hitherto, a dried drug contained in a drug vessel such as a vial has been dissolved in solvent such as purified water, physiological saline solution, or glucose solution for drip injection at a medical organization such as a hospital.

For simple and convenient use in these cases, there has been proposed a fluid vessel in which a vial containing a dried drug is connected in series to a solvent vessel containing solvent, whereby the two vessels are communicated in a sterile manner at the time of using (for example, Japanese Laid-open PCT Publication No. Sho 61(1986)-501129, Japanese Laid-open Patent Publication No. Hei 2(1990)-1277, and Japanese Laid-open Utility Model Publication No. Sho 63(1988)-135642).

The one disclosed in Japanese Laid-open PCT Publication No. Sho 61(1986)-501129 is a device in which a capsule having a drug vessel and a solvent vessel containing solvent are connected by a tube, whereby the drug vessel and the solvent vessel are communicated by means of a communication means provided in the tube so as to mix the drug and the solvent in a sterile manner. The one disclosed in Japanese Laid-open Patent Publication No. Hei 2(1990)-1277 is a fluid vessel as shown in FIG. 21, in which a hollow puncturing needle 117 having a hub in the middle and having knife-edges at both ends is interposed between a drug vessel 112 and a solvent vessel 111 containing solvent, and which is constructed in such a manner that the puncturing needle 117 first pierces the drug vessel 112 and then pierces the solvent vessel 111, whereby the communication between the drug vessel 112 and the solvent vessel 111 can be secured and facilitated and the mixing of the drug and the solvent after the start of communication can be carried out in a short time and in a sterile manner.

The one shown in Japanese Laid-open Utility Model Publication No. Sho 63(1988)-135642 is a device in which a tubular, suitably detachable support ring is provided at a sealing portion of a mouth portion of a solvent vessel and in which a double-edged needle is mounted onto the support ring so that the needle is slidable upwards and downwards, whereby the lower needle pierces the sealing portion of the mouth portion of the solvent vessel when the double-edged needle is allowed to slide downwards.

With respect to these fluid vessels, there has been a problem that, since the drug vessel and the solvent vessel are basically connected in a partitioned state and also it is necessary to provide, at the connecting portion, a means for mixing the drug and the solvent in the two vessels at the time of use, the total length of the fluid vessel (the length along the connecting direction) is unnecessarily long, the transportation cost is higher and it is difficult to secure the storage space. Also, in the hospitals, there is an inconvenience that a hanger must be held high in order to obtain a sufficient height difference for natural dripping. Of course, these fluid vessels are all integrated bodies incorporating therein a vial as it is, which is a typical form of distributing a dried drug and, in that sense, these vessels have a high applicability for wide uses.

However, these conventional fluid vessels, for example, the one disclosed in Japanese Laid-open PCT Publication No. Sho 61(1986)-501129, has a drawback that it has a lot of components and it takes time to bend the breaking member by hands to open a passage and, moreover, when the bending of the breaking member is incomplete, the solution is hard to pass and it takes too much time to carry out the dissolution of the drug. The fluid vessel disclosed in Japanese Laid-open Patent Publication No. Hei 2(1990)-1277 has complicated components such as a communication sequence regulating means and it has a lot of components as a whole, although there is a considerable improvement as compared with the fluid vessel of the above-mentioned Japanese Laid-open PCT Publication No. Sho 61(1986)-501129 with respect to preventing the contamination of the inside drug and simplifying the communication between the drug vessel and the solvent vessel. The fluid vessel disclosed in Japanese Laid-open Utility Model Publication No. Sho 63(1988)-135642 has a smaller number of components and is comparatively easy to handle, but it requires a comparatively large force for starting the communication, and it is necessary that the support ring and the double-edged needle are removed after the drug and the solvent are mixed, the solvent vessel is reversed, and an infusion set or the like is connected to the sealing portion of the mouth portion of the solvent vessel after the double-edged needle has been drawn out, so that the operation takes time and there is a fear that the mixed drug solution may leak out at the time of drawing the double-edged needle out.

SUMMARY OF THE INVENTION

The present invention has been made in view of the above circumstances, and the first object of the invention is to provide a fluid vessel in which the above operation is easy and does not take so much time, in which there is no fear of leakage of the mixed drug solution, and in which the number of components is small and the drug and the solvent can be mixed in a sterile manner.

The second object of the invention is to shorten the total length of the fluid vessel, to reduce the transportation costs thereby, to facilitate the storage in hospitals and the like, to adapt it for mass transportation era, and to facilitate the handling operation in hospitals.

DISCLOSURE OF THE INVENTION

A fluid vessel according to the present invention comprises: a drug vessel with a mouth portion sealed with a plug capable of being pierced; a vial guide for holding the drug vessel; a solvent vessel deformable by pressing and made of synthetic resin, the solvent vessel having, on end portions thereof, a drug solution takeout port and a communication port to a drug vessel closed with a thin film to pack the solvent tightly, and the solvent vessel being further provided with a tubular guide portion concentrically surrounding the communication port; a communication means for communicating an inside of the solvent vessel and an inside of the drug vessel, the communication means housed in the guide portion of the solvent vessel so that the communication means is capable of sliding in upward and downward directions; and a cap for housing the vial guide and for rotatably sealing an opening of the guide portion.

Further, a drug vessel push-down means for moving down the drug vessel in cooperation is disposed on the inner wall of the cap, the inner wall of the guide portion, and the vial guide, and the fluid vessel further includes a communication sequence control mechanism for controlling a communication sequence so that, when the cap is rotated, the vial guide is moved down, without rotating, by the drug vessel push-down means, reaches the communication means, pierces through a plug of a mouth portion of the drug vessel held by the vial guide, further pierces through a thin film of a communication port of the solvent vessel by its downward movement accompanied by the communication means, and communicates the drug vessel with the solvent vessel.

According to the present invention, the lower end of the guide portion may be embedded in the solvent vessel and the communication port may be formed in the lower end.

According to the present invention, the vial guide preferably comprises: a drug vessel mouth portion holding section for holding the mouth portion of the drug vessel; a plurality of flexible rib members that extend from the drug vessel mouth portion holding section upwards along the drug vessel and are stopped by a bottom corner portion of the drug vessel; an oblique cut surface formed in an upper end of the flexible rib member and being slidable along a cam formed on the inner wall of the cap; and a flexible pawl piece extending downwards continuously from the lower end of the flexible rib member and being slidably fitted onto the inside wall of the guide portion.

According to the present invention, the drug vessel push-down means preferably comprises an oblique cut surface and a flexible pawl piece of the vial guide, a cam disposed on the inside wall of the cap, and a plurality of longitudinally running grooves disposed on the inside wall of the guide portion to run longitudinally.

According to the present invention, the communication means preferably comprises a double-edged needle having a hub in the middle.

According to the present invention, the communication sequence control mechanism preferably comprises a pressing engagement portion formed in the outer periphery of the hub to be capable of being moved in the radial direction of the hub, an engagement step portion formed in the longitudinally running groove to be engageable with the pressing engagement portion, and a control rod disposed on the outer wall of the drug vessel mouth portion holding section of the vial guide. Here, the control rod controls the communication sequence so that, when the vial guide is moved down, the control rod prevents the pressing engagement portion engaged with the engagement step portion from being moved inside in the radial direction of the hub and, while maintaining the engagement between the pressing engagement portion and the engagement step portion, pierces the rubber plug of the drug vessel mouth portion with one blade edge of the double-edged needle, then allows the other blade edge of the double-edged needle to pierce the thin film of the communication port of the solvent vessel by releasing the engagement between the pressing engagement portion and the engagement step portion so as to communicate the drug vessel with the solvent vessel.

According to the present invention, the longitudinally running groove of the guide portion preferably comprises a sliding surface for deforming the flexible pawl piece of the vial guide inwards to release the stopping engagement of the flexible rib member at the bottom corner portion of the drug vessel when the communication means pierces the thin film of the communication port of the solvent vessel.

The fluid vessel according to the present invention preferably comprises a cap removal means. Further, the cap removal means preferably comprises: an annular projection formed on the outer end edge of the guide portion and a linear protrusion formed in the upper portion of the annular projection; an engagement ring including an engagement projection formed on its inner wall and engageable with the annular projection, a rotation prevention projection formed further above the engagement projection, a groove formed in the circumferential direction on the outer wall, an open end formed on one side of the groove and open to the upper end side of the outer wall, and a closed end formed on the other side of the groove; and a rib formed on the inner wall of the cap and introduced from the open end to be engaged with the closed end, wherein, when the cap is rotated in one direction on the upper end edge of the guide portion, the rib of the cap rotates together with the engagement ring by being engaged with the closed end of the engagement ring and, when the cap is rotated in the other direction, the rotation prevention projection of the engagement ring engages with the linear protrusion of the upper end edge of the guide portion and the rib moves relatively from the closed end to the open end, whereby the cap can be removed from the guide portion.

Referring to FIG. 1, the construction of the drug vessel push-down means and the operation of the communication sequence control mechanism are explained. The pawl piece 66 of the vial guide 6 externally fitted onto the drug vessel 1 is fitted into the longitudinally running groove 44 of the guide portion 4, and the oblique cut surface 65 of the vial guide 6 is fitted onto the cam 56 (FIG. 13) of the cap 5. In this construction, the oblique cut surface 65 of the vial guide 6 slides along the cam 56 by rotation of the cam 56 when the cap 5 is rotated clockwise. The pawl piece 66 moves down while sliding along the cam 56 of the cap 5 because the vial guide 6 does not rotate together with the cap 5 due to the engagement between the pawl piece 66 and the longitudinally running groove 44.

When the vial guide 6 moves down, the control rod 63 provided at the vessel mouth portion holding section 60 of the vial guide 6 maintains, as shown in FIG. 18, an engagement between the engagement step portion 41 and the pressing engagement portion 38 of the hub 34 so that the pressing engagement portion 38 is not released from the engagement step portion 41 by being moved inwards in the radial direction of the hub 34 by a pressing force. At this time, the upper puncturing needle 35 of the double-edged needle 3 fixed to the engagement step portion 41 receives the downward moving vessel mouth portion holding section 60 and pierces the rubber plug 12 of the drug vessel 1.

When the control rod 63 is further pushed downwards and its upper end portion passes the pressing engagement portion 38, the pressing engagement portion 38 moves inward in the radial direction by a pressing force to release the engagement with the engagement step portion 41, as shown in FIG. 19. Next, as shown in FIG. 20, the hub 34 is further pushed down to pierce the thin film 47 of the communication port 45 of the solvent vessel 2 with the lower puncturing needle 36 of the double-edged needle 3, and the control rod 63 goes into the hole 34*a* of the hub 34. Thus, the communication operation of the drug vessel 1 and the solvent vessel 2 is extremely easily achieved by the rotation of the cap 5. Namely, since the fluid vessel includes the above-mentioned communication sequence control function, the communication sequence of the communication means is controlled so that the piercing of the rubber plug 12 of the mouth portion 11 of the drug vessel is carried out first and the piercing of the thin film 47 of the communication port 45 is carried out later. Therefore, the leakage of the solvent into the guide portion 4 at the time of communication is prevented.

In the fluid vessel according to the present invention, the vial guide 6 is guided by the flexible pawl piece 66 moving along the longitudinally running groove 44 of the guide portion 4 when the vial guide 6 moves down. At this time, since the sliding surface 46 formed in the longitudinally running groove 44 has opposing tapered surfaces which converge at the lower position (FIG. 20), the downward moving pawl piece 66 is gradually deformed inwards. In accordance with the deformation of the pawl piece 66, the upper end of the flexible rib member 62 connected continuously to the pawl piece 66 is gradually deformed outwards. This releases the stopping engagement with the bottom corner portion of the drug vessel 1. Therefore, the used drug vessel 1 can be easily taken out of the vial guide 6. Here, since the upper end portion of the control rod 63 of the vial guide 6 is held by the pressing engagement portion 38 of the hub 34 that has moved inwards in the radial direction so as to fix the vial guide 6 to the double-edged needle 3, it is possible to draw only the drug vessel 1 out from the upper puncturing needle 35. Therefore, the hands of the user are not damaged by the lower puncturing needle 36 when the drug vessel 1 is removed.

In the fluid vessel according to the present invention, a cap removal means may be used for removing the cap from the guide portion after an infusion has been carried out by using the vessel. Referring to FIGS. 10 to 17, concrete examples of the construction and the operation of the cap removal means are explained. The cap removal means is constructed with a cooperation of a guide portion 4, an engagement ring 7, and a cap 5. The guide portion 4 is provided with an annular projection 48 formed in the upper end edge and a linear protrusion 49 formed in the upper part of the projection 48. The engagement ring 7 is provided with an engagement projection 72 formed in the inner wall of the engagement ring 7 and is engageable with the annular projection 48, a rotation prevention projection 75 formed on a further upper portion of the engagement projection 72, a groove 77 formed in a circumferential direction on the outer peripheral wall of the engagement ring 7, an open end 71 located on one side of the groove 77 and open to the upper end side of the outer peripheral wall, and a closed end (stopper projection 74) formed on the other side of the groove. The cap 5 includes a rib 58 on the inner wall. The rib 58 is introduced from the open end 71 to be engaged with the closed end.

When the cap 5 is rotated in one direction on the upper end edge of the guide portion 4, the cap 5 is engaged with the closed end 74 of the engagement ring 7 and rotates together with the engagement ring 7. Next, when the cap 5 is rotated in a reverse direction, the rotation prevention projection 75 of the engagement ring 7 engages with the linear protrusion 49 of the upper end edge of the guide portion 4 and the rib 58 moves relatively from the closed end (stopper projection 74) to the open and 71, whereby the cap 5 can be removed from the guide portion 4.

In this invention, the solvent vessel is provided with a tubular guide portion concentrically surrounding the communication port to the drug vessel and, preferably, the lower end portion of the guide portion is embedded integrally in the solvent vessel. Therefore, the total length of the fluid vessel (the length in the direction of connecting the drug vessel to the solvent vessel) can be made significantly shorter than the conventional vessels, achieving easy storage of fluid vessels in hospitals or the like, providing compactness suitable for transportation, and reducing the transportation costs.

Also, in the present invention, the guide portion 4 including the communication port 45 formed on its lower end portion is integrally molded as a part of the solvent vessel 2, unlike the conventional example of FIG. 21 in which the bottom portion of the guide portion 126 and the communication port of the solvent vessel 111 are moulded as different pieces. Therefore, it is possible to omit a complicated structure for sealing and connecting the two portions and to reduce the number of components.

Also, in hospitals, a sufficient height difference can be ensured for achieving natural dripping of the infusion solution without using a high stand.

Moreover, since the upper end portion of the flexible rib member 62 of the vial guide 6 is pressingly widened to release the stopping engagement of the drug vessel 1 at its bottom corner portion, it is easy to remove the drug vessel 1 from the vial guide 6 if the used fluid vessel is to be discarded separately. Thus, the present invention provides fluid vessels that are easy to be discarded separately after use and are excellent in discardability.

BEST EMBODIMENTS FOR REDUCING THE INVENTION INTO PRACTICE

Figure 1:
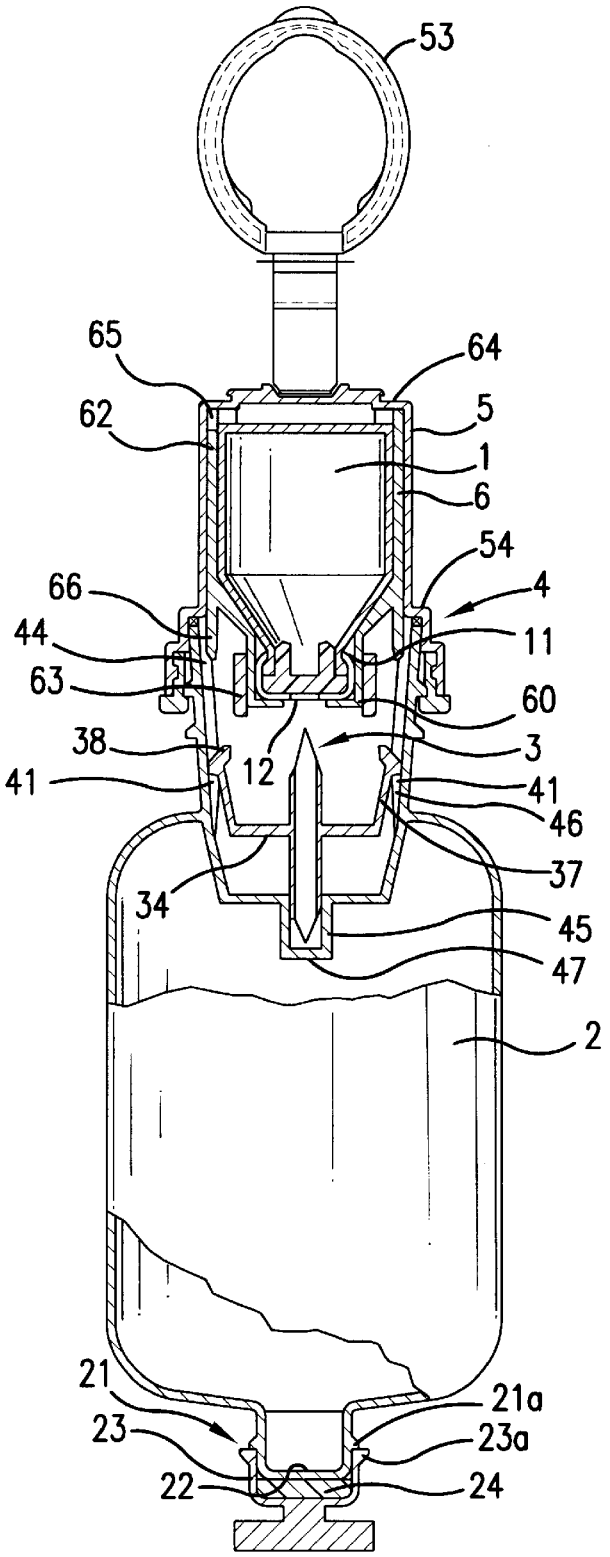
FIG. 1 is a cross section of the essential part of the fluid vessel according to one embodiment of the present invention.

Next, the preferred embodiments of the present invention are described in conjunction with the drawings. Referring to FIG. 1, the fluid vessel according to the present invention is constructed mainly with a drug vessel 1, a solvent vessel 2, a double-edged needle 3, a guide portion 4, a cap 5, and a vial guide 6. The lower end portion of the guide portion 4 is integrally embedded into the solvent vessel 2. The upper end portion, namely the open end of the guide portion 4 is sealed with the cap 5. In the guide portion 4 are housed the double-edged needle 3 and the vial guide 6 downwardly holding the mouth portion 11 of the drug vessel 1 so that they are slidable in a downward direction. The drug vessel 1 is mounted so that its mouth portion 11 is held by the vessel mouth portion holding section 60 formed in a lower position of the vial guide 6 in the figure. It is constructed in such a manner that, when the cap 5 is rotated clockwise, the drug vessel 1 moves down together with the vial guide 6 to pierce, with the double-edged needle 3, the rubber plug 12 of the drug vessel 1 and the thin film 47 of the communication port 45 formed at the lower end of the guide portion 4 so as to allow communication between the two vessels 1 and 2.

Figure 2:
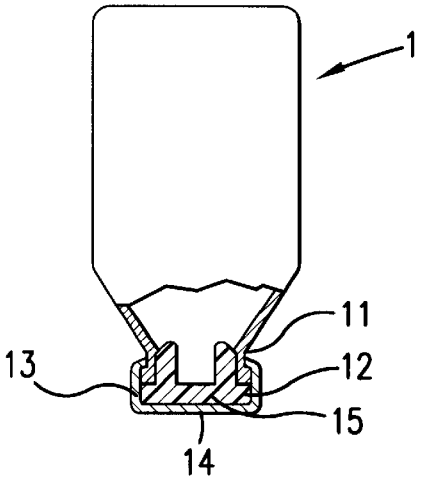
FIG. 2 is a cross section of the essential part of the drug vessel of FIG. 1.

The drug vessel 1 is generally made of glass and, as shown in FIG. 2, its mouth portion 11 is sealed with a sealing member such as a rubber plug 12 capable of being pierced with the double-edged needle 3 and having a self-sealing property. The body portion 15 of the rubber plug 12 is surrounded and fastened with a cover member 13 made of aluminum or the like and is fixed to the mouth portion 11 of the vessel 1. A commercially available drug vessel is usable as the drug vessel 1. In assembling the fluid vessel, the top surface of the cover member 13 is removed and a through-hole 14 is formed at a position where the puncturing needle of the double-edged needle 3 pierces the body portion 15 of the rubber plug 12. The drug vessel 1 may be formed of synthetic resin, and the rib member 62 and the flexible pawl piece 66 of the vial guide 6 as shown in FIG. 1 may be provided on the outer wall of the body portion of the vessel, thereby omitting the vial guide 6. However, if the drug vessel is made of glass as in this example, it is difficult to form these projecting members on the drug vessel, so that it is preferable to form the vial guide 6 with a synthetic resin and to mount the drug vessel 1 in the vial guide 6. Although the drug vessel 1 contains a dried drug such as a powdered drug, a freeze-dried drug, or the like, the drug is omitted in the drawings. Specifically, examples of the dried drugs are as follows.

Antibiotics are, for example, cephem antibiotics such as cefazolin sodium, ceftizoxime sodium, cefotiam hydrochloride, cefmenoxime hydrochloride, cefacetrile sodium, cefamandole sodium, cefaloridine, cefotaxime sodium, cefotetan sodium, cefoperazone sodium, cefsulodin sodium, ceftezole sodium, cefpiramide sodium, cefmetazole sodium, cefuroxime sodium, cefocules sulfate, etc. and penicillin antibiotics such as ampicillin sodium, carbenicillin disodium, sulbenicillin disodium, ticarcillin sodium, etc. Antitumor agents are, for example, mitomycin C, fluorouracil, tegafur, cytarabine, etc. Antiulcer agents are, for example, famotidine, ranitidine hydrochloride, cimetidine, etc.

The vial guide 6 for housing and holding the drug vessel 1 as shown in FIG. 1 and for moving down the drug vessel 1 without rotating it, is integrally moulded with a synthetic resin such as polyethylene resin, polypropylene resin, polyester resin, polyvinyl chloride resin, polycarbonate resin, acrylonitrile-butadiene-styrene (ABS) resin, etc. The vial guide 6 is mainly constructed with a drug vessel mouth portion holding section 60 and a pair of flexible rib members 62, as shown in FIGS. 6 to 9. The mouth portion holding section 60 is a tubular member having an inner diameter such that the outer peripheral surface of the cover member 13 of the drug vessel 1 can be inserted therein. At the bottom surface of the mouth portion holding section 60 is formed a piercing hole 61 for the double-edged needle 3, the piercing hole 61 being larger than the through-hole 14 of the drug vessel 1. On the outer peripheral surface of the mouth portion holding section 60 is formed a pair of control rods 63 facing each other. The control rods 63 are linear rod members of the width of several millimeters capable of being inserted into the holes 34*a* of the later-mentioned hub 34 and are integrally formed with the mouth portion holding section 10.

The lower end portion of the control rod 63 extends a little below the bottom surface (lower in the Figure) of the mouth portion holding section 60. Also, the upper end portion of the control rod 63 is located above the body portion of the rubber plug 12 (the portion to be pierced by the upper puncturing needle 35) when the drug vessel 1 is held by the vial guide 6. Above the mouth portion holding section 60 in the Figure is formed a support portion diverging from the mouth portion holding section 60 along the shoulder portion of the drug vessel 1. Further, opposing flexible rib members 62 are disposed extending upwards from the upper edge portion of the support portion. The rib members 62 extend a little above the height of the body portion of the drug vessel 1 when being mounted to the vial guide 6. On one end of the upper portion of each rib member 62 is formed a drug vessel stopper pawl 64 capable of stopping the bottom corner portion of the drug vessel 1 to be housed in the vial guide 6. The drug vessel stopper pawls 64 are bent inwards at substantially right angles from the upper portions of the rib members 62. This allows the user to mount or remove the drug vessel 1 in the mouth portion holding section 60 with the rib members 62 being widened outwards by pushing. On the other end of the upper portion of each rib member 62 is formed an oblique cut surface 65 as an oblique cut surface portion. The pair of these oblique cut surfaces 65 are slidable along the cam 56 formed on the later-mentioned inner portion of the cap 5.

On the other hand, on the lower end of the rib member 62 is formed a flexible pawl piece 66 continuously extending downwards from the edge of the mouth portion holding section 60 to the rib member 62. The flexible pawl piece 66 is a flat member having substantially the same width as the rib member 62 and is constructed with projecting pieces that are projecting in two branches. The interval between the two projecting pieces is constructed to be a little wider than the width of the later-mentioned engagement step portion 41 of the guide portion 4. The lower end of the pawl piece 66 extends near to the upper end of the control rod 63. When the pawl piece 66 is pressed in a radial direction, the drug vessel stopper pawl 64 is also moved in a radial direction, since the rib member 62 and the pawl piece 66 are a portion of the vial guide 6 that has been integrally formed with a resin. Namely, when the pawl piece 66 is pressed inwards in a radial direction, the rib member 62 is pressed outwards in a radial direction.

Figure 10:
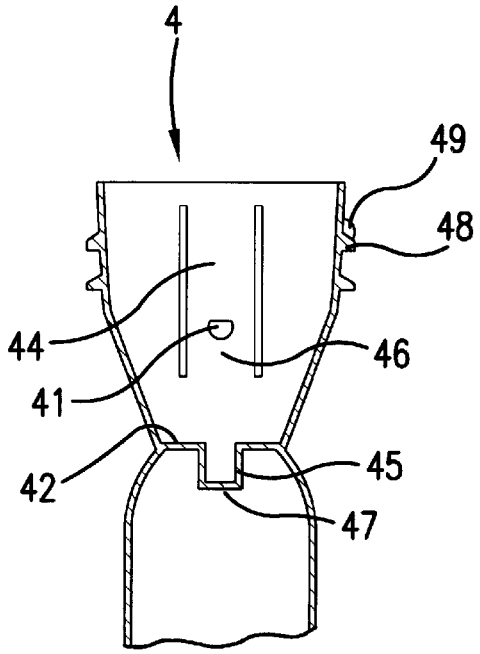
FIG. 10 is a cross section of the guide portion of FIG. 1.
Figure 11:
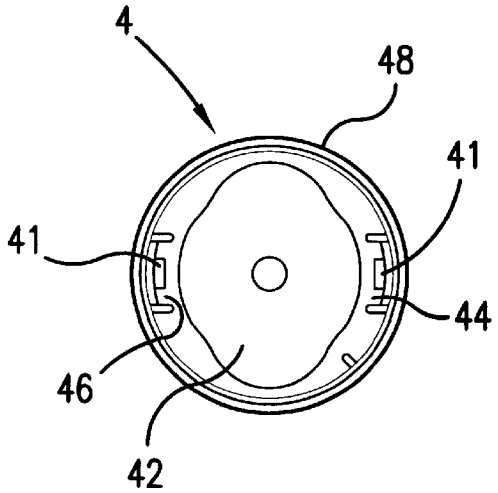
FIG. 11 is a plan view of FIG. 10.

A part of the vial guide 6 to which the drug vessel 1 is mounted is housed in the guide portion 4 together with the double-edged needle 3. As a part of the solvent vessel 2, the guide portion 4 is integrally formed with a synthetic resin similar to that of the vial guide 6 and has an open end as an upper end portion and a separating wall 42 as a lower end portion, as shown in FIGS. 10 and 11. An annular projection 48 is formed near the open end side for connecting to the cap 5 via the cap removal means shown in FIG. 1. Further, a pair of linear protrusions 49 is formed above the annular projection 48. On the inside wall of the guide portion 4 is formed a pair of opposing longitudinally running grooves 44 which run longitudinally from the separating wall 42 towards the open end. The longitudinally running grooves 44 serve for lowering the vial guide 6 without rotating it by engagement with the flexible pawl piece 66 of the vial guide 6. In the longitudinally running groove 44 is formed a later-mentioned engagement step portion 41 for controlling the order of piercing by the double-edged needle 3. Near the engagement step portion 41 in the longitudinally running groove 44 is formed a later-mentioned sliding surface 46. The annular projection 48 is a projection that engages with the later-mentioned engagement projection 72 of the engagement ring 7 as the cap removal means. By engagement with the later-mentioned rotation prevention projection 75 of the engagement ring 7, the linear protrusion 49 serves to prevent rotation of the engagement ring 7 in a counter-clockwise direction.

The separating wall 42 has a communication port 45 to the solvent vessel, which communication port 45 is formed in a concave step shape in the middle. The communication port 45 includes a thin film 47 in the bottom portion thereof as a closing film capable of being pierced by the lowering movement of (the lower puncturing needle 36 of) the later-mentioned double-edged needle 3.

If the cap removal means is not to be provided, the annular projection 48 is unnecessary and, in this case, complementary undercuts may be each provided in the open end of the guide portion 4 and the lower end of the skirt 55 (FIG. 12) of the cap 5, and these undercuts may be engaged so that the cap 5 is freely rotatable.

The double-edged needle 3 adopted as the communication means is disposed between the drug vessel 1 and the solvent vessel 2, as shown in FIG. 1, and is generally constructed with a cannula made of stainless steel (preferably SUS304) or synthetic resin and with a hub made of synthetic resin. If the sharpness of the needle should be emphasized, a cannula made of stainless steel is preferable. However, considering the problem of discarding and in view of integral moulding, it is preferable to use a double-edged needle made of synthetic resin. As the synthetic resin to be used, a hard resin such as a high density polyethylene, an ABS resin, a polycarbonate resin, etc. is preferable.

Figure 3:
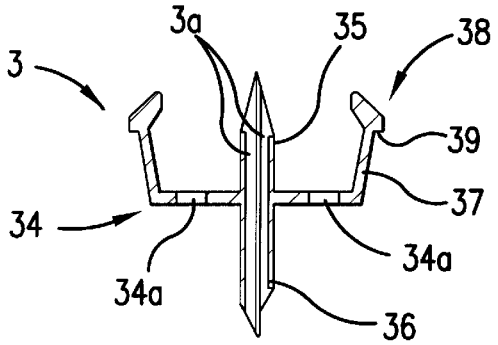
FIG. 3 is a cross section of the double-edged needle of FIG. 1.
Figure 4:
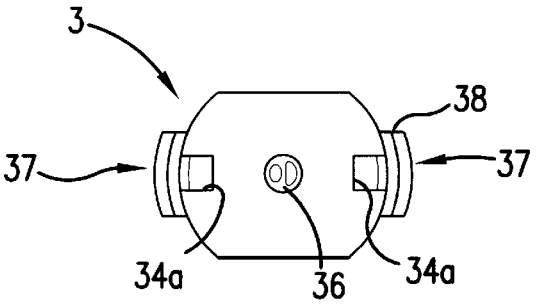
FIG. 4 is a bottom view of FIG. 3.
Figure 5:
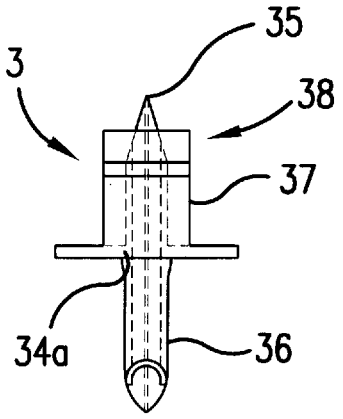
FIG. 5 is a side view of FIG. 3.
Figure 6:
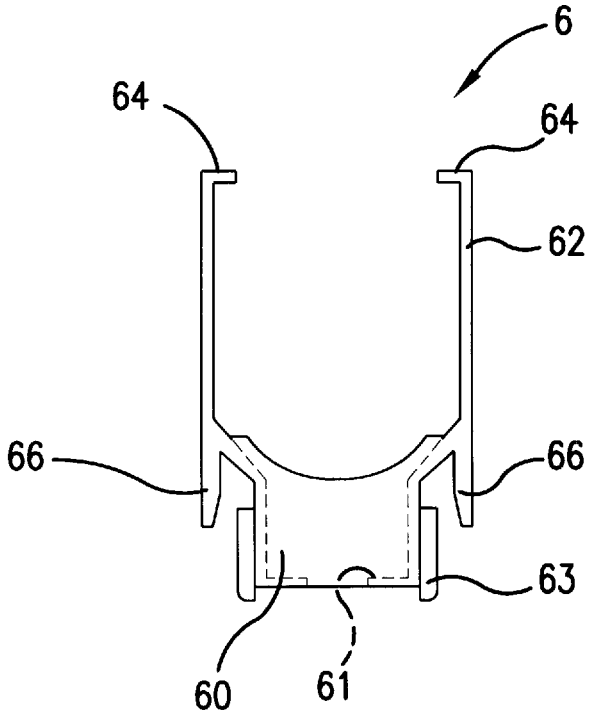
FIG. 6 is a front view of the vial guide of FIG. 1.
Figure 7:
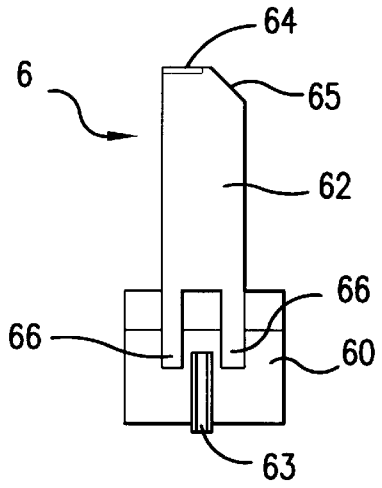
FIG. 7 is a side view of the vial guide of FIG. 6.
Figure 8:
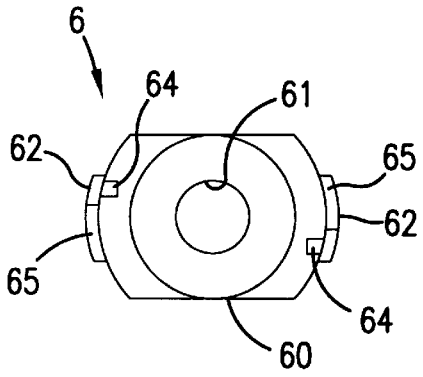
FIG. 8 is a plan view of the vial guide of FIG. 6.
Figure 9:
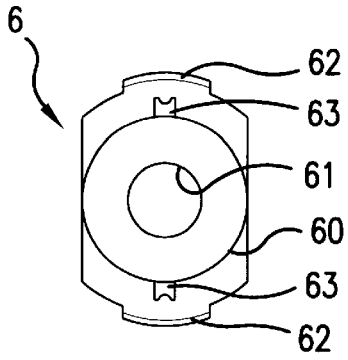
FIG. 9 is a bottom view of the vial guide of FIG. 6.

Referring to FIGS. 3 to 5, the double-edged needle 3 comprises a hub 34, an upper puncturing needle 35 for piercing the rubber plug 12 of the drug vessel 1, and a lower puncturing needle 36 for piercing the thin film 47 of the communication port 45 formed on the lower end of the guide portion 4 so that the double-edged needle 3 first pierces the rubber plug 12 of the mouth portion 11 of the downward-moving drug vessel 1 and then is moved down together with the drug vessel 1 to pierce the thin film 47 of the communication port 45 formed on the lower end of the guide portion 4. Preferably, at the tip end of the hub 34 is provided an engagement arm 37 for controlling the downward movement of the double-edged needle 3 by its engagement with the longitudinally running groove 44 of the guide portion 4. At the tip end of the engagement arm 37 is formed a pressing engagement portion 38 engageable with the engagement step portion 41. The pressing engagement portion 38 engages with the longitudinally running groove 44 by means of a jaw 39 formed at the tip end of the pressing engagement portion 38. The upper puncturing needle 35 is formed to have a sharp blade edge pointed at its central portion. The lower puncturing needle 36 is formed to have a blunt blade edge. However, the shape of the blade edge is not specifically limited. At the base portion of the hub 34 are formed holes 34*a* into which the lower end portions of the control rods 63 of the vial guide 6 are to be inserted. The holes 34*a* serve to stop the rotation of the vial guide 6.

Although, in the Figure, two drug solution passageways 3*a* are provided in the upper and lower puncturing needles 35 and 36, the number of outlets is not specifically limited. If two or more outlets are formed in arrangement, it is possible to move the drug solution without pressing the solvent vessel 2.

The solvent vessel 2 is generally a vessel formed of a comparatively soft synthetic resin such as polyethylene resin, polypropylene resin, polyester resin, etc. and it is freely deformable by pressing. The lower end of the guide portion 4 is integrally embedded into the upper portion of the solvent vessel 2. A drug solution takeout port 21 is provided at the lower end portion of the solvent vessel 2.

The drug solution takeout port 21 is constructed in the same manner as in an ordinary fluid bottle. For example, a construction is adopted in which a closing film 22 is covered with a sealing member including a pressing member 23 and a rubber plug 24 attached thereto, as shown in FIG. 1. The sealing member is mounted to the solvent vessel 2 by welding the flange 21*a* formed on the outer wall of the drug solution takeout port 21 and the flange 23*a* formed in the pressing member 23. Here, the rubber plug 24 of the sealing member may be protected with a cover member such as a film so that its surface is not contaminated, although not shown in the Figure.

The fluid vessel of the present invention is completed when the lower end of the guide portion 4 is integrally embedded into the upper portion of the solvent vessel 2, and the double-edged needle 3 and the mouth portion 11 side of the drug vessel 1 are set in the guide portion 4, and the cap 5 is mounted airtightly to the open end of the guide portion 4.

Figure 12:
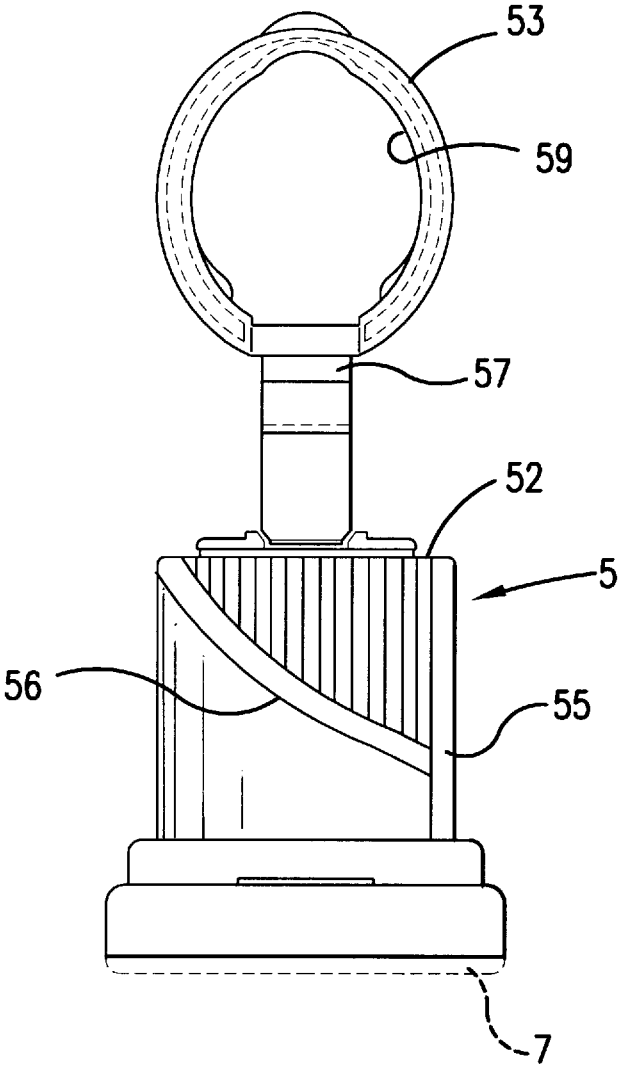
FIG. 12 is a front view of the cap of FIG. 1.
Figure 13:
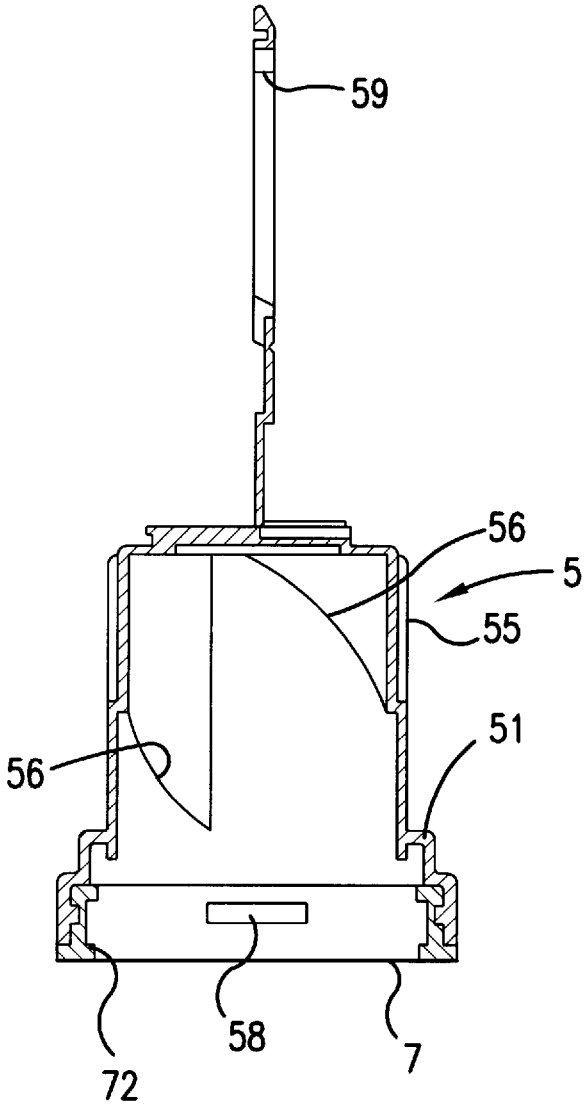
FIG. 13 is a side sectional view of the cap of FIG. 12.
Figure 14:
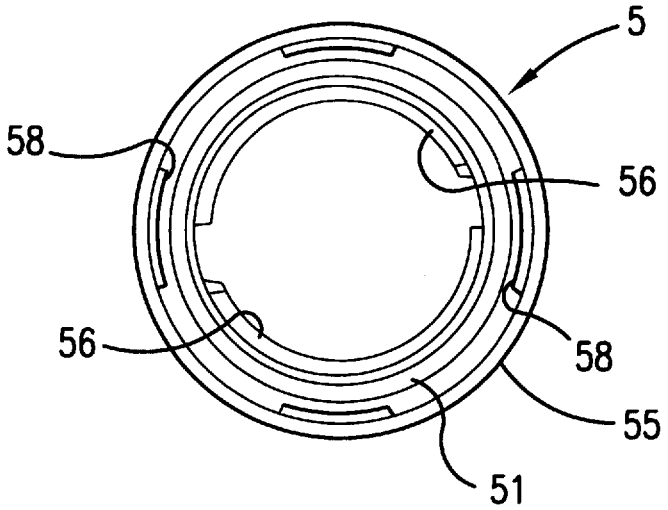
FIG. 14 is a bottom view of the cap of FIG. 1.
Figure 15:
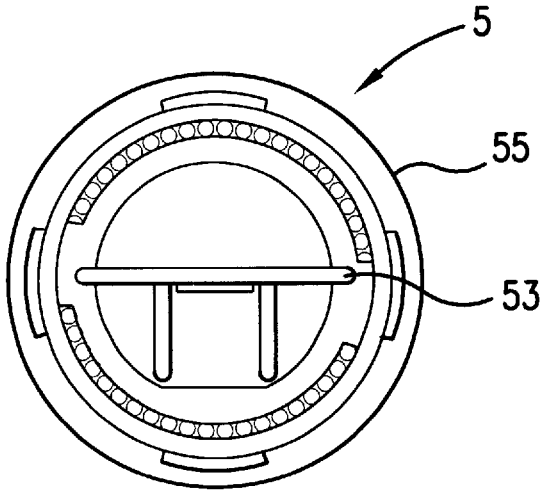
FIG. 15 is a plan view of the cap of FIG. 1.

The cap 5 serves to seal the open end of the upper end of the guide portion 4 and also serves as a drug vessel push-down means that allows the drug vessel 1 to move downwards. The cap 5 is generally formed into a tubular shape with a synthetic resin similar to that of the guide portion 4, as shown in FIGS. 12 and 13. Preferably, a hanging member 53 is provided at the top surface 52 of the cap 5. At the lower end of the skirt 55 which is a side wall of the cap 5, there is formed a sealing member mounting groove 51 for housing the sealing member 54 (See FIG. 1) that provides airtight sealing between the cap 5 and the guide portion 4. On the inner wall of the skirt 55 is formed a cam 56 that slides in close contact with the oblique cut surface 25 of the vial guide 6. The hanging means 53 may include a hinged portion 57 so that the hanging means may be folded up. If the cap removal means is to be adopted, there may be provided, at the lower end portion of the inner surface of the skirt 55, a rib 58 that engages with the groove of the engagement ring 7, as shown in FIGS. 14 and 15. Here, the reference numeral 59 represents a hanging hole.

The cam 56 is formed of a pair of spiral step portions facing each other in the inner wall surface of the skirt 55. Each of the spiral step portions is semi-circular. The cam 56, the oblique cut surfaces 65 and the flexible pawl pieces 66 of the vial guide 6, and the longitudinally running grooves 44 of the guide portion 4 together construct the drug vessel push-down means. Although not shown in the Figure, it is possible to adopt a linear protrusion obliquely running in a spiral instead of the cam 56.

Figure 16:
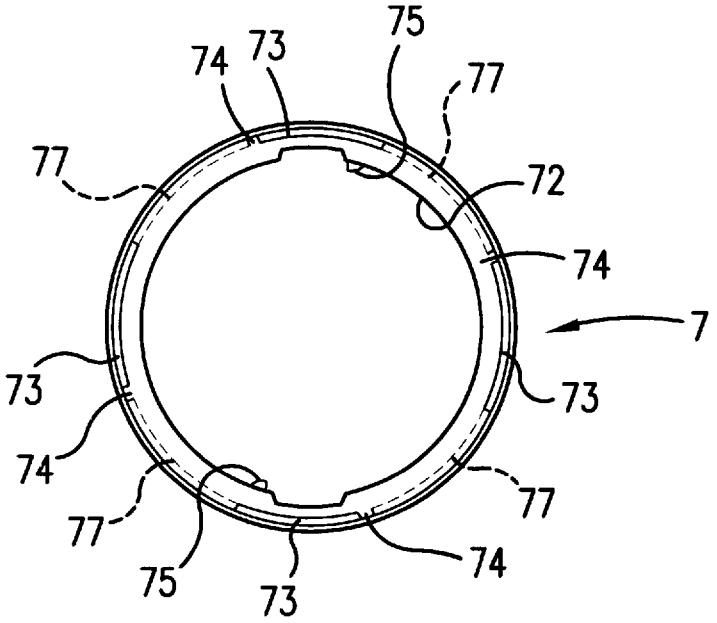
FIG. 16 is a plan view of the engagement ring.
Figure 17:
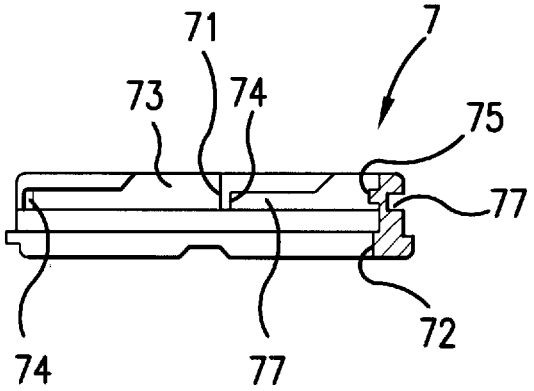
FIG. 17 is a side view including a cross section of the engagement ring of FIG. 16.

The cap removal means serves to remove the cap 5 from the guide portion 4 so as to separately discard the drug vessel 1 and the double-edged needle 3. The cap removal means is mainly constructed with an engagement ring 7 and ribs 58 formed on the inner surface of the cap 5. The engagement ring 7 is a member formed in a ring-like shape, as shown in FIGS. 16 and 17. On the inside of the engagement ring 7 is formed an engagement projection 72 engageable with the annular projection 48 of the guide portion 4 so that the engagement ring 7 is freely rotatable and, on the outside of the engagement ring 7 are formed grooves 77 that engage with the ribs 58 on the inside wall of the lower end of the cap 5.

Four grooves 77 are intermittently formed in a circumferential direction, and the rift 73 of the groove that forms the open end 71 is formed to have a shape such that the upper side wall portion constituting the groove 77 is cut out, namely, in a step-like shape. Accordingly, the length of the rib 58 of the cap 5 is shorter than the rift 73 of the groove. A stopper projection 74 is provided as a closed end between the clockwise running groove 77 and the rift 73 of the groove, so that, when the cap 5 is rotated clockwise, the rib 58 impinges on the stopper projection 74 to allow the engagement ring 7 to rotate together with the cap 5 and to hold the rib 58 of the cap 5 in the groove 77 and, when the cap 5 is rotated counterclockwise, the rib 58 comes to the rift 73 of the groove. In this case, since the rib 58 is formed to be shorter than the rift 73 of the groove, the cap 5 is removed from the engagement ring 7 if the cap 5 is moved upwards when the rib 58 comes to the rift 73 of the groove.

Here, since the engagement ring 7 is almost entirely covered with the lower end portion of the skirt 55 of the cap 5 as shown in FIG. 12, it is impossible to rotate only the engagement ring 7 by hand. Accordingly, there is provided, on the inner wall of the upper end portion of the engagement ring 7, a rotation prevention projection 75 that engages with the linear protrusion 49 (FIG. 10) provided on the outer wall of the open end of the guide portion 4 so that the engagement ring 7 may not be rotated together with the cap 5 when the cap 5 is to be removed. In order that the engagement ring 7 may not be rotated when the cap 5 is rotated counterclockwise, it is so configured that the linear protrusion 49 of the guide portion 4 goes over the rotation prevention projection 75 just when the cap 5 is rotated clockwise to communicate the drug vessel 1 and the solvent vessel 2.

Although the cap removal mechanism including the groove 77, the rift 73 of the groove, and the stopper projection 74 is formed outside the engagement ring 7 in FIGS. 16 to 17, it is possible to form the cap removal mechanism inside the engagement ring 7 to combine the mechanism with a projection (a portion corresponding to the rib 58) formed on the outer wall of the lower end portion of the skirt 55 of the cap 5. Alternatively, the cap removal means may be provided on the inner wall or the outer wall of the cap 5 to combine the cap removal means with a similar projection provided on the outer wall or the inner wall of the engagement ring 7, respectively. However, if the cap removal means or projection is provided on the outer wall of the cap 5, it is necessary to provide an additional means for preventing removal of the cap 5 before use because it is possible to remove the cap 5 by rotating only the engagement ring 7 in a counterclockwise direction although the cap 5 cannot be rotated in a counterclockwise direction before use since the cam 56 of the cap 5 is engaged with the oblique cut surface 65 of the vial guide 6.

Here, the fluid vessel of FIG. 1 can be allowed to stand upside down when the hanging means 53 of the cap 5 is folded up. Also, the fluid vessel of FIG. 1 can be allowed to stand with the lower end portion of the solvent vessel 2 facing downwards.

Next, the method of using the fluid vessel according to the present invention is described.

Referring to FIG. 1, the construction and the operation of the drug vessel push-down means are explained. The pawl piece 66 of the vial guide 6 fitted on the drug vessel 1 is fitted into the longitudinally running groove 44 of the guide portion 4. The oblique cut surface 65 of the vial guide 6 is fitted to the cam 56 of the cap 5. By this construction, the oblique cut surface 65 of the vial guide 6 slides along the cam 56 due to the rotation of the cam 56 when the cap 5 is rotated in a clockwise direction. The pawl piece 66 moves downward while sliding along the cam 56 of the cap 5, since the vial guide 6 does not rotate together with the cap 5 because of the engagement of the pawl piece 66 with the longitudinally running groove 44.

Figure 18:
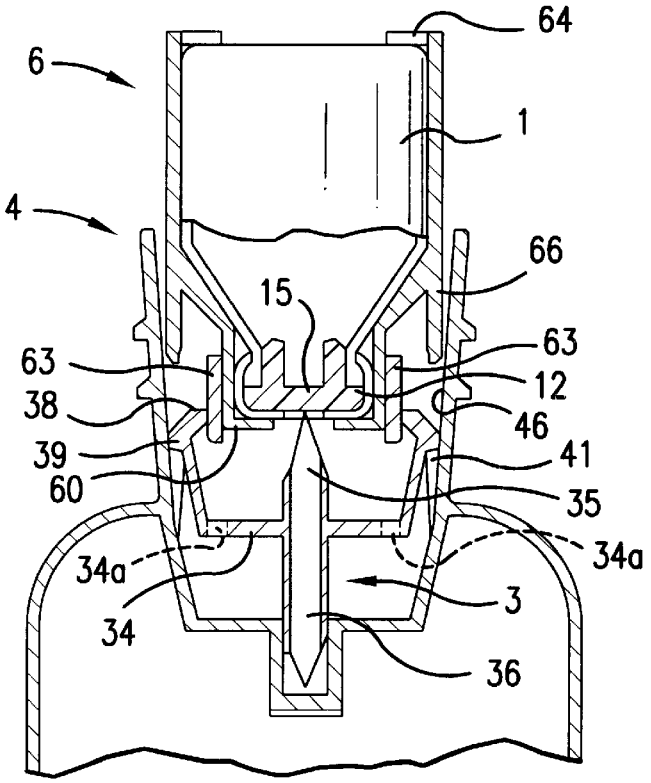
FIG. 18 is an explanatory view showing the initial state in the operation of the double-edged needle and the engagement arm of FIG. 1.

When the vial guide 6 moves down, the control rod 63 provided on the vessel mouth portion holding section 60 of the vial guide 6 prevents the pressing engagement portion 38 of the hub 34 engaged with the engagement step portion 41 from being moved inwards in a radial direction of the hub 34 so as to prevent the release of the engagement of the pressing engagement 38 with the engagement step portion 41, as shown in FIG. 18. At this time, the upper puncturing needle 35 of the double-edged needle 3 fixed to the engagement step portion 41 receives the vessel mouth portion holding section 60 moving down and pierces the body portion 15 of the rubber plug 12 of the drug vessel 1 that is held.

Figure 19:
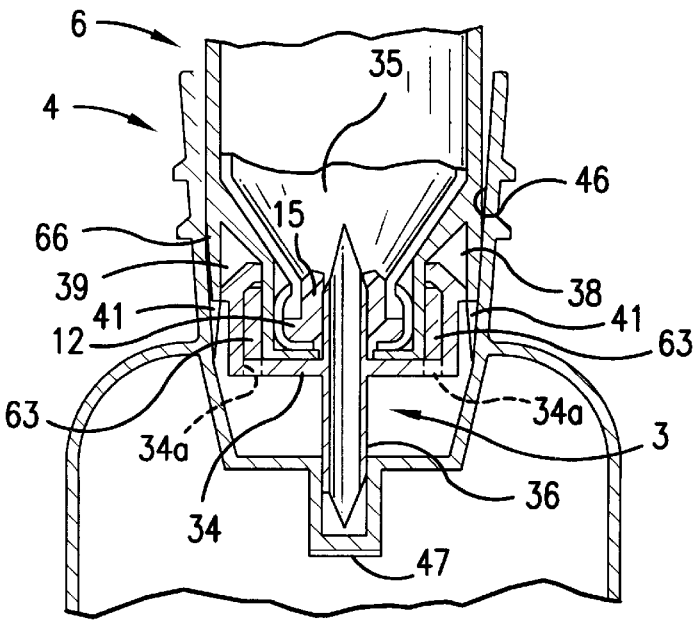
FIG. 19 is a view corresponding to FIG. 18 and showing a state in which the double-edged needle is pushed down.

When the control rod 63 is further pushed down to allow its upper end portion to pass the pressing engagement portion 38, the pressing engagement pressing portion 38 moves inwards in a radial direction by a pressing force to release the engagement with the engagement step portion 41, as shown in FIG. 19.

Figure 20:
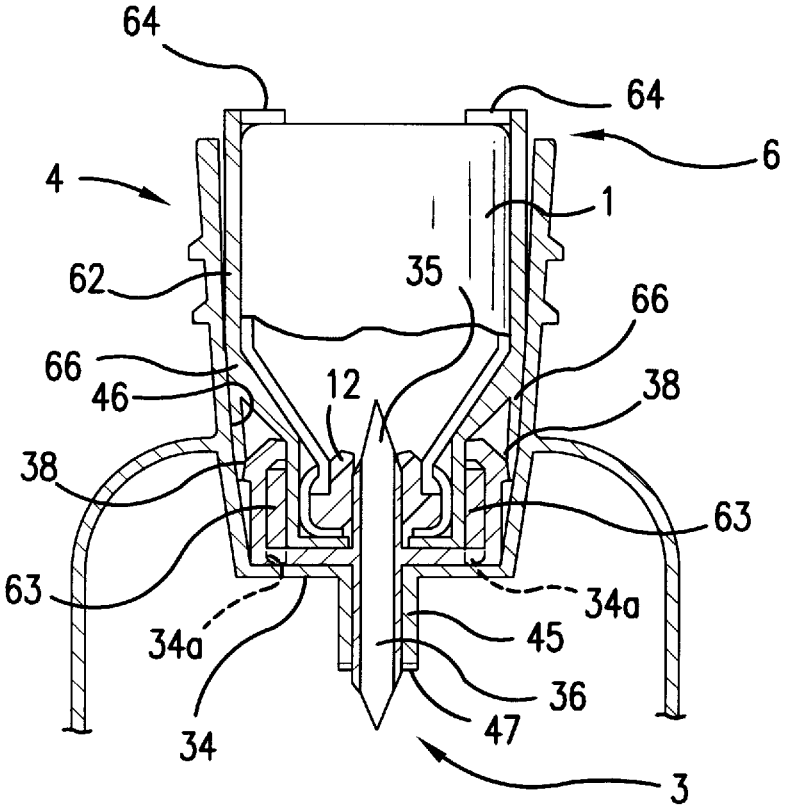
FIG. 20 is a view corresponding to FIG. 18 and showing a state in which the double-edged needle is further pushed down.
Figure 21:
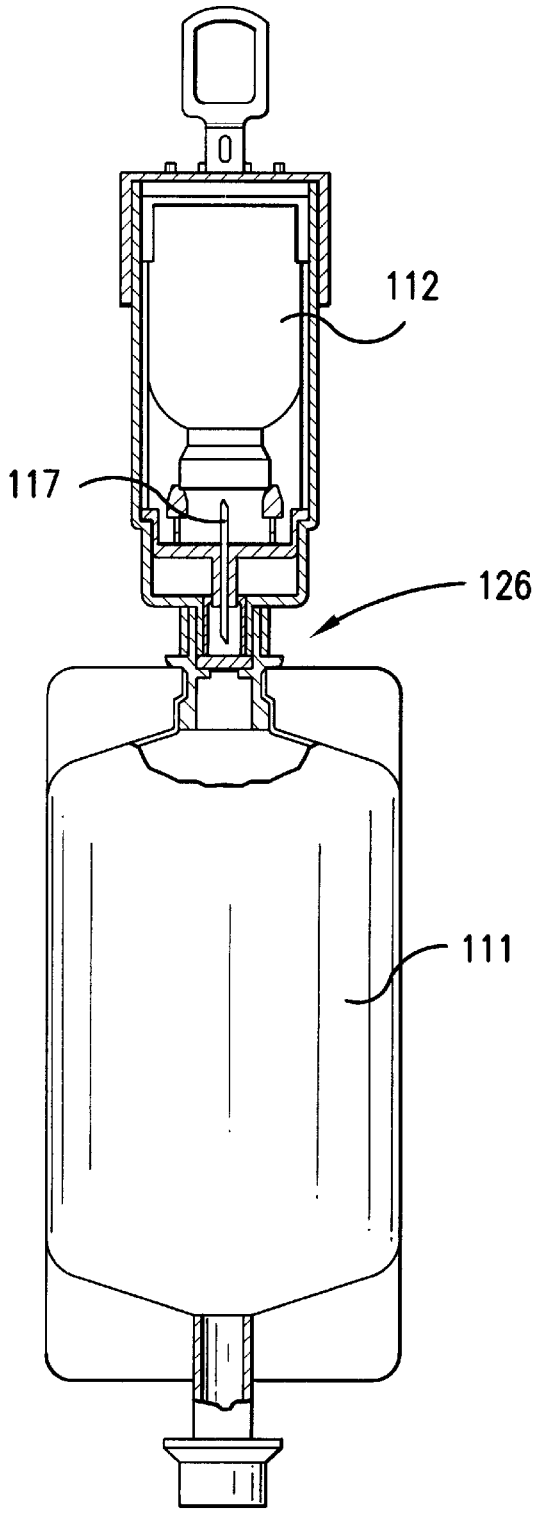
FIG. 21 is a cross section of the essential part of a conventional fluid vessel corresponding to FIG. 1.

Next, when the hub 34 is further pushed down as shown in FIG. 20, the pawl piece 66 moves downwards crossing the engagement step portion 41. The control rod 63 goes into a hole 34*a* of the hub 34. This allows the thin film 47 of the communication port 45 of the solvent vessel 2 to be pierced with the lower puncturing needle 36 of the double-edged needle 3. Thus, when the drug vessel 1 and the solvent vessel 2 are allowed to communicate by means of the double-edged needle 3, the solvent vessel 2 is deformed by pressing, preferably upside down. This allows the solvent in the solvent vessel 2 to flow into the drug vessel 1 and to mix with the dried drug in the drug vessel 1 to produce a drug solution. Then, the infusion treatment can be started after the drug solution in the drug vessel 1 is returned into the solvent vessel 2 by pumping the solvent vessel 2 and an infusion set or the like is connected to the drug solution takeout port 21.

Thus, the communication between the drug vessel 1 and the solvent vessel 2 is achieved extremely easily by the rotation of the cap 5. Since the fluid vessel of the present invention includes this communication sequence control mechanism, the communication sequence is controlled in such a manner that the rubber plug 12 of the mouth portion 11 of the drug vessel is pierced first, and then the thin film 47 of the communication port 45 is pierced later. Therefore, it is possible to prevent the leakage of the solvent into the guide portion 4 at the time of starting the liquid communication.

When a fluid vessel according to the present invention is discarded after infusion has been carried out using the fluid vessel, the cap removal means for removing the cap from the guide portion may be employed. The operation of the cap removal means is explained (See FIGS. 12 to 17).

When the cap 5 is rotated in one direction at the upper end edge of the guide portion 4, the cap 5 rotates together with the engagement ring 7 by engagement of the rib 58 with the stopper projection 74. Further, when the engagement ring 7 is rotated in an opposite direction, the rotation prevention projection 75 engages with the linear protrusion 49 of the upper end edge of the guide portion 4 and the rib 58 moves relatively from the stopper projection 74 to the open end 71, whereby the cap 5 can be easily removed from the guide portion 4. Therefore, the drug vessel 1, the double-edged needle 3, and the like can be taken out and discarded separately.

Further, a means for removing the drug vessel 1 from the vial guide 6 may be used. Explanation is given on the removal means. When the vial guide 6 moves downwards, the vial guide 6 is directed by the flexible pawl piece 66 moving along the longitudinally running groove 44 of the guide portion 4. At this time, since the sliding surface 46 formed in the longitudinally running groove 44 has tapered surfaces that are facing each other and contracting at a lower position, the downward-moving pawl piece 66 is gradually deformed inwards. In accordance with the deformation of the pawl piece 66, the upper end of the rib member 62 serially connected to the pawl piece 66 is gradually deformed outwards. This releases the stopping engagement of the bottom corner portion of the drug vessel 1. Accordingly, the used drug vessel 1 can be removed easily from the vial guide 6.

At this time, since the upper end portion of the control rod 63 of the vial guide 6 is held by the pressing engagement portion 38 that has moved inwards in a radial direction of the hub 34 to fix the vial guide 6 to the double-edged needle 3, it is possible to draw out the drug vessel 1 alone from the upper puncturing needle 35. Therefore, the hands of the user are damaged by the lower puncturing needle 36 when the drug vessel 1 is removed.

INDUSTRIAL APPLICABILITY

As shown above, by adopting the fluid vessel of the present invention, it is possible to provide a fluid vessel in which the mixing operation is easy and does not take so much time, in which there is no fear of leakage of the mixed drug solution, and in which the drug and the solvent can be mixed in a sterile manner. Also, according to the present invention, the lower end portion of the guide portion is embedded in the solvent vessel and, therefore, the total length of the fluid vessel (the length in the direction of connecting the drug vessel to the solvent vessel) can be made shorter, achieving easy storage of fluid vessels in hospitals or the like, and providing compactness suitable for transportation.

The sequence in piercing with the communication means is controlled in such a manner that the rubber plug of the mouth portion of the drug vessel is pierced first, and then the thin film of the communication port is pierced later. Therefore, the communication between the drug vessel and the solvent vessel can be made firm and easy, and the mixing of the drug and the solvent after starting the communication can be carried out in a short time and in a sterile manner.

Further, fluid vessels can be provided with a low price because the complicated structure for connecting the capsule with the solvent vessel can be omitted and the number of components can be reduced.

According to the fluid vessel of the present invention, the total length of the fluid vessel is made shorter because the lower end of the guide portion is embedded in the solvent vessel and a communication port is formed at the lower end. Therefore, the transportation cost is saved and the storage space can be easily secured.

According to the fluid vessel of the present invention, the vial guide comprises a drug vessel mouth portion holding section, a pair of flexible rib members (oblique cut surfaces) stopped at the bottom corner portion of the drug vessel, and flexible pawl pieces. Therefore, it is possible to remove the drug vessel easily from the vial guide when the used fluid vessel is discarded separately. At this time, the drug vessel alone can be drawn out from the communication means, the hand of the user is not damaged with the double-edged needle when the drug vessel is removed. Moreover, the drug vessel made of glass can be easily separated from the synthetic resin portion which forms the body of the fluid vessel.

According to the fluid vessel of the present invention, the drug vessel push-down means is constructed with a cam, a longitudinally running groove, an oblique cut surface, and a flexible pawl piece. Therefore, by rotating the cap, the vial guide can be moved downwards without being rotated, so that the force required for communication is smaller.

According to the fluid vessel of the present invention, the communication sequence control mechanism is constructed with a pressing engagement member formed on the outside peripheral portion of the hub and movable in a radial direction of the hub; an engagement step portion formed in the longitudinally running groove; and a control rod provided on the outer wall of the drug vessel mouth portion holding section of the vial guide. Therefore, there is no need to add new members and the components of the control mechanism can be more simplified.

According to the fluid vessel of the present invention, when the communication means has pierced the thin film of the communication port of the solvent vessel, the sliding surface allows the flexible pawl piece to be deformed inwards to release the stopping engagement of the flexible rib member at the bottom corner portion of the drug vessel. Therefore, by a series of piercing operations with the communication means, the drug vessel can be removed easily from the vial guide.

According to the fluid vessel of the present invention, in case the guide portion is equipped with a cap removal means, the cap can be removed easily after use. Therefore, the components of the fluid vessel can be easily discarded separately. Also, the vial guide can be removed from the cap with certainty provided that, when the cap is rotated in one direction at the upper end edge of the guide portion, the cap rotates together with the engagement ring by engagement of the rib with the closed end and, when the engagement ring is rotated in an opposite direction, the rotation prevention projection engages with the linear protrusion of the upper end edge of the guide portion and the rib moves relatively from the closed end to the open end whereby the cap can be removed from the guide portion.

What we claim is:

1. A fluid vessel, comprising:

a drug vessel with a mouth portion sealed with a penetrable plug;

a vial guide which holds the drug vessel;

a flexible solvent vessel having, on end portions thereof, a drug solution outlet port and a communication port to the drug vessel, and having a tubular guide portion concentrically surrounding the communication port;

a communication means for communicating an inside of the solvent vessel and an inside of the drug vessel, the communication means being housed in the guide portion of the solvent vessel so that the communication means is capable of sliding in upward and downward directions; and a cap for housing the vial guide and for rotatably sealing an opening of the guide portion, wherein a drug vessel push-down means for moving down the drug vessel in cooperation is disposed on an inner wall of the cap, an inner wall of the guide portion, and the vial guide, and wherein the fluid vessel further includes a communication sequence control mechanism for controlling a communication sequence so that, when the cap is rotated, the vial guide is moved down, without rotating, by the drug vessel push-down means, and the communication means first pierces through the plug of the drug vessel held by the vial guide, and then pierces through a thin film of the communication port of the solvent vessel by its downward movement accompanied by the communication means, and communicates the drug vessel with the solvent vessel, wherein a lower end of the guide portion is embedded in the solvent vessel and the communication port is formed in the lower end.

2. A fluid vessel according to claim 1 wherein the vial guide, comprises:

a drug vessel mouth portion holding section which holds the mouth portion of the drug vessel;

a plurality of flexible rib members that extend from the drug vessel mouth portion holding section upwards along the drug vessel and are stopped by a bottom corner portion of the drug vessel;

an oblique cut surface formed in an upper end of the flexible rib member and being slidable along a cam formed on the inner wall of the cap; and a flexible pawl piece extending downwards continuously from the lower end of the flexible rib member and being slidably fitted onto the inside wall of the guide portion.

3. A fluid vessel according to claim 1, wherein the drug vessel push-down means, comprises:

an oblique cut surface and a flexible pawl piece of the vial guide;

a cam disposed on the inside wall of the cap; and a plurality of longitudinally running grooves disposed on the inside wall of the guide portion.

4. A fluid vessel according to claim 1, wherein the communication means comprises a double-edged needle having a hub in the middle.

5. A fluid vessel according to claim 4, wherein the communication sequence control mechanism, comprises:

a pressing engagement portion formed in the outer periphery of the hub movable in the radial direction of the hub;

an engagement step portion formed in the longitudinally running groove to be engageable with the pressing engagement portion; and a control rod disposed on the outer wall of the drug vessel mouth portion holding section of the vial guide to control the communication sequence so that, when the vial guide is moved down, the control rod prevents the pressing engagement portion engaged with the engagement step portion from being moved inside in the radial direction of the hub and, while maintaining the engagement between the pressing engagement portion and the engagement step portion, pierces the rubber plug of the drug vessel with one blade edge of the double-edged needle, then allows the other blade edge of the double-edged needle to pierce the thin film of the communication port of the solvent vessel by releasing the engagement between the pressing engagement portion and the engagement step portion so as to communicate the drug vessel with the solvent vessel.

6. A fluid vessel according to claim 3, wherein at least one of the longitudinally running grooves of the guide portion comprises a sliding surface for deforming the flexible pawl piece of the vial guide inwards to release the stopping engagement of the flexible rib member at the bottom corner portion of the drug vessel when the communication means pierces the thin film of the communication port of the solvent vessel.

7. A fluid vessel according to claim 1, further comprising a cap removal means.

8. A fluid vessel according to claim 7, wherein the cap removal means, comprises:

an annular projection formed on an outer end edge of the guide portion and a linear protrusion formed in an upper portion of the annular projection;

an engagement ring including an engagement projection formed on its inner wall and engageable with the annular projection, a rotation prevention projection formed further above the engagement projection, a groove formed in a circumferential direction on the outer wall, an open end formed on one side of the groove and opened to the upper end side of the outer wall, and a closed end formed on the other side of the groove; and a rib formed on the inner wall of the cap and introduced from the open end to be engaged with the closed end, wherein, when the cap is rotated in one direction on the upper end edge of the guide portion, the rib of the cap rotates together with the engagement ring by being engaged with the closed end of the engagement ring and, when the cap is rotated in the other direction, the rotation prevention projection of the engagement ring engages with the linear protrusion of the upper end edge of the guide portion and the rib moves relatively from the closed end to the open end, whereby the cap can be removed from the guide portion.

9. A fluid vessel, comprising:

a drug vessel with a mouth portion sealed with a penetrable plug;

a vial guide which holds the drug vessel;

a flexible solvent vessel having, on end portions thereof, a drug solution outlet port and a communication port to the drug vessel, and having a tubular guide portion concentrically surrounding the communication port;

a communication means for communicating an inside of the solvent vessel and an inside of the drug vessel, the communication means being housed in the guide portion of the solvent vessel so that the communication means is capable of sliding in upward and downward directions; and a cap for housing the vial guide and for rotatably sealing an opening of the guide portion, wherein a drug vessel push-down means for moving down the drug vessel in cooperation is disposed on an inner wall of the cap, an inner wall of the guide portion, and the vial guide, wherein the fluid vessel further includes a communication sequence control mechanism for controlling a communication sequence so that, when the cap is rotated, the vial guide is moved down, without rotating, by the drug vessel push-down means, and the communication means first pierces the plug of the drug vessel held by the vial guide, and then pierces a thin film of the communication port of the solvent vessel by its downward movement accompanied by the communication means, and communicates the drug vessel with the solvent vessel, and wherein the vial guide, comprises:

a drug vessel mouth portion holding section which holds the mouth portion of the drug vessel;

a plurality of flexible rib members that extend from the drug vessel mouth portion holding section upwards along the drug vessel and are stopped by a bottom corner portion of the drug vessel;

an oblique cut surface formed in an upper end of the flexible rib member and being slidable along a cam formed on the inner wall of the cap; and a flexible pawl piece extending downwards continuously from the lower end of the flexible rib member and being slidably fitted onto the inside wall of the guide portion, and wherein a lower end of the guide portion is embedded in the solvent vessel and the communication port is formed in the lower end.

10. A solvent vessel having an input port and an output port, comprising:

an integrally molded guide portion surrounding the input port of the solvent vessel;

a communication means housed within the guide portion for communicating an inside of a drug vessel inserted into the guide portion and an inside of the solvent vessel; and controlling means for controlling the order of communication in such a manner that the drug vessel is first opened and thereafter the input port of the solvent vessel is opened, wherein a lower end of the guide portion is embedded in the solvent vessel and the communication port is formed in the lower end.

11. The solvent vessel according to claim 10, further comprising:

a vial guide which holds the drug vessel and is inserted into the guide portion of the solvent vessel.

12. The solvent vessel according to claim 10, further comprising:

a rotatable cap covering said guide portion, which when rotated, downwardly moves the drug vessel towards the input port of the solvent vessel.

13. The solvent vessel according to claim 10, further comprising:

a pushable cap covering said guide portion, which when pushed, downwardly moves the drug vessel towards the input port of the solvent vessel.

14. The solvent vessel according to claim 10, wherein the communication means comprises a double-edged needle having a hub in the middle portion thereof.

15. The solvent vessel according to claim 10, wherein the input port includes a closing film covering the input port.

16. The solvent vessel according to claim 10, wherein the solvent vessel is made of synthetic resin.

17. The solvent vessel according to claims 12 or 13, wherein the cap has a hanger member at its top surface.

18. The solvent vessel according to claim 10, further comprising:

locking means for locking the communication means in a lower portion of the guide portion so that the drug vessel may be removed separate from the communication means.

* * * * *